US006494184B2

(12) United States Patent
Nawa et al.

(10) Patent No.: US 6,494,184 B2
(45) Date of Patent: Dec. 17, 2002

(54) AIR-FUEL MIXTURE CONTROL DEVICE OF ENGINE

(75) Inventors: Hideaki Nawa, Obu (JP); Kazuhiko Nishimura, Obu (JP); Yasunori Sakaue, Obu (JP); Satomi Wada, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 4 days.

(21) Appl. No.: 09/796,484

(22) Filed: Mar. 2, 2001

(65) Prior Publication Data

US 2001/0023685 A1 Sep. 27, 2001

(30) Foreign Application Priority Data

Mar. 16, 2000 (JP) ..... 2000-073483

(51) Int. Cl.[7] ..... F02M 69/00; F02M 37/04
(52) U.S. Cl. ..... 123/470; 123/478; 123/509
(58) Field of Search ..... 123/470, 472, 123/478, 480, 509; 73/119 A

(56) References Cited

U.S. PATENT DOCUMENTS 5,094,212 A * 3/1992 Kawaguchi et al. ..... 123/470
5,482,021 A * 1/1996 Roche ..... 123/456
5,634,448 A * 6/1997 Shinogle et al. ..... 123/480
6,167,855 B1 * 1/2001 Mammarella et al. ... 123/90.38

FOREIGN PATENT DOCUMENTS

JP 10-159622 6/1998

* cited by examiner

*Primary Examiner*—Terry M. Argenbright
(74) *Attorney, Agent, or Firm*—Oliff & Berridge, PLC

(57) ABSTRACT

An air-fuel mixture control device 12 controlling a combustible air-fuel mixture to be supplied to a combustion chamber 19 of an engine 11. This device 12 is constructed of an injector 35 used for fuel supply, a fuel pump, a fuel filter, a fuel pressure regulator, and an electronic control unit (ECU) 64, which are united as an assembly with respect to a throttle body 26 including an intake passage 24 and a throttle valve 25. A memory incorporated in the ECU 64 stores a correction value with respect to the fuel injection quantity dispersion preliminarily experimentally determined on an assembly-by-assembly basis. The ECU 64 corrects the fuel injection quantity based on the correction value stored in the memory to control the fuel injection quantity.

8 Claims, 14 Drawing Sheets

AIR-FUEL MIXTURE CONTROL DEVICE OF ENGINE

BACKGROUND OF THE INVENTION

1. Field of the Invention

The present invention relates to an air-fuel mixture control device of an engine to be used for vehicles such as motorcycles, and more particularly to an air-fuel mixture control device for controlling a mixture of fuel and air to be supplied to a combustion chamber of an engine.

2. Description of Related Art

Heretofore, there is a case where a fuel injection device is used as, for example, an air-fuel mixture control device to be used in a motorcycle. One of such the devices is provided with a throttle body including an intake passage, a fuel injection valve for injecting fuel into the intake passage, a fuel pump for supplying under pressure the fuel to the fuel injection valve, a pressure regulator for regulating the pressure of fuel to be supplied to the fuel injection valve, a fuel filter for removing foreign materials from the fuel to be supplied, and an electronic control unit for controlling the quantity of fuel to be injected from the fuel injection valve.

In the above device, generally, the throttle body, the fuel injection valve, the fuel pump, the pressure regulator, the fuel filter, the electronic control unit, and other components are mounted separately in respective corresponding positions in a vehicle. In particular, the fuel pump and the pressure regulator are normally incorporated in a fuel tank. On the other hand, the components used for fuel supply (fuel-system component), such as the throttle body, the fuel injection valve, the fuel pump, the pressure regulator, and the fuel filter, individually include somewhat dispersion in fuel flow quantity. Thus, each engine would include the cumulative dispersion in fuel flow quantity due to assembly of the fuel-system components. This causes the generation of dispersion in air-fuel ratio among engines. To reduce the dispersion in air-fuel ratio, each fuel-system component needs machining with high accuracy.

However, the increase of machining accuracy could not fully compensate malfunctions caused by the flow quantity dispersion in the fuel-system components. Hence, there is a conventional case where, for example, during a manufacturing process of an engine, a test run of an engine after completely assembled is made by putting the engine on a lapping table and then applying a predetermined load to the engine. At this time, a fuel injection quantity and output of the engine are measured, and the fuel injection quantity and the engine output are regulated to predetermined set values.

Japanese Patent Unexamined Publication No. 10-159622 discloses an engine output automatic adjusting device related to the above test run. With this automatic adjusting device, an engine in which the fuel injection quantity is controlled by an electronic control unit is test-run under a predetermined condition. The engine output during the test run is detected by a torque sensor. A deviation of a detected value from a target value is then calculated. The calculated deviation is stored in advance in a nonvolatile memory in the electronic control unit. In subsequent operations, a fuel injection quantity is controlled on the basis of the deviation value. To be more specific, during engine operation, a fuel injection quantity is calculated based on values of an engine rotational speed, a throttle opening degree, and others, and then the calculated value is corrected based on the above deviation value. The control of engine fuel injection quantity is executed based on the above correction value of a fuel injection quantity so that the dispersion in the fuel injection quantity is reduced according to the characteristics of each individual engine.

In the conventional device disclosed in the above publication, the fuel injection quantity is corrected based on the engine output torque, which results in total correction of plural factors such as the individual dispersion in flow quantity in the fuel-system components, the dispersion in engine friction, and others. As a result, the conformity of the air-fuel ratio to a request air-fuel ratio would be insufficient, causing a possibility of deterioration in the emission of the engine.

Furthermore, the conventional device conducts the test run for test with respect to an engine assembly, which causes an increase in size of testing equipment.

SUMMARY OF THE INVENTION

The present invention has been made in view of the above circumstances and has an object to overcome the above problems and to provide an air-fuel mixture control device of an engine, capable of reducing the influence of dispersion in fuel flow quantity in each of a fuel injection valve and fuel supplying devices, on an air-fuel mixture, and thereby improving the conformity of an engine air-fuel ratio.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an air-fuel mixture control device for controlling a mixture of air and fuel to be supplied to a combustion chamber of an engine, the device including: a throttle body including an intake passage communicated to the combustion chamber and a throttle valve provided in the intake passage; a fuel injection valve for injecting the fuel into the intake passage; a fuel supplying device for supplying the fuel under pressure to the fuel injection valve; and an electronic control unit for controlling an injection quantity of the fuel to be injected from the fuel injection valve; wherein the throttle body, the fuel injection valve, the fuel supplying device, and the electronic control unit are united, forming an assembly.

According to the above structure of the invention, the throttle body, fuel injection valve, fuel supplying device, and electronic control unit are united as an assembly, so that the air flow rate characteristics related to the air to be allowed to flow in the intake passage through the throttle valve and the fuel injection quantity characteristics related to the fuel to be injected into the intake passage through the fuel supplying device and the fuel injection valve are determined in each assembly, or air-fuel mixture control device, which differ from assembly to assembly. Accordingly, in each individual assembly, the fuel injection quantity into the intake passage is regulated and the air flow rate in the intake passage is also regulated. This makes it possible to control the characteristics of an air-fuel mixture to be produced in the intake passage in each assembly, separately from an engine body.

The test on the dispersion related to the fuel injection quantity in each assembly is conducted, so that a correction value determined based on the dispersion can be stored in the memory. At the control of the fuel injection quantity, the electronic control unit refers to the correction value stored in the memory. Consequently, the dispersion in the fuel injection quantity in each assembly can be corrected on an individual basis. Thus, the characteristics of an air-fuel mixture can be standardized.

The air-fuel mixture control device may further include a memory for storing a correction value to be used for correcting dispersion in the fuel injection quantity, the memory being provided in the electronic control unit.

Preferably, the fuel supplying device includes a fuel filter and a pressure regulator which are integrally combined by caulking.

Preferably, the fuel supplying device further includes a fuel pump, and the combined fuel filter and pressure regulator are arranged perpendicularly to the fuel pump.

Preferably, an intake condition detector for detecting an intake condition in the intake passage is provided in the united assembly.

Preferably, the electronic control unit controls the fuel injection quantity based on at least the intake condition detected by the detector.

According to another aspect of the present invention, there is provided an air-fuel mixture control system for controlling a mixture of air and fuel to be supplied to a combustion chamber of an engine, the system including: a throttle body including an intake passage communicated to the combustion chamber and a throttle valve provided in the intake passage; a fuel injection valve for injecting the fuel into the intake passage; a fuel supplying device for supplying the fuel under pressure to the fuel injection valve; and an electronic control unit for controlling an injection quantity of the fuel to be injected from the fuel injection valve, the throttle body, the fuel injection valve, the fuel supplying device, and the electronic control unit being united, forming an assembly; a memory for storing a correction value with respect to dispersion related to the fuel injection quantity determined by a preliminary test on an assembly-by-assembly basis, the memory being provided in the electronic control unit; and the electronic control unit being operated to correct the fuel injection quantity based on the correction value stored in the memory for control of the fuel injection quantity.

In the above air-fuel control system, preferably, the preliminary test includes controlling the fuel injection valve to inject the fuel by a predetermined request injection quantity under a predetermined injection signal, then measuring an actual injection quantity of the fuel injected from the fuel injection valve, and determining a deviation of the measured value with respect to the request injection quantity as the dispersion in the injection quantity.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a first embodiment of an air-fuel mixture control device of an engine and an air-fuel mixture control system of an engine embodying the present invention will now be given referring to the accompanying drawings. In the first embodiment, the control device and system are adopted in an engine of a small-sized motorcycle.

Figure 1:
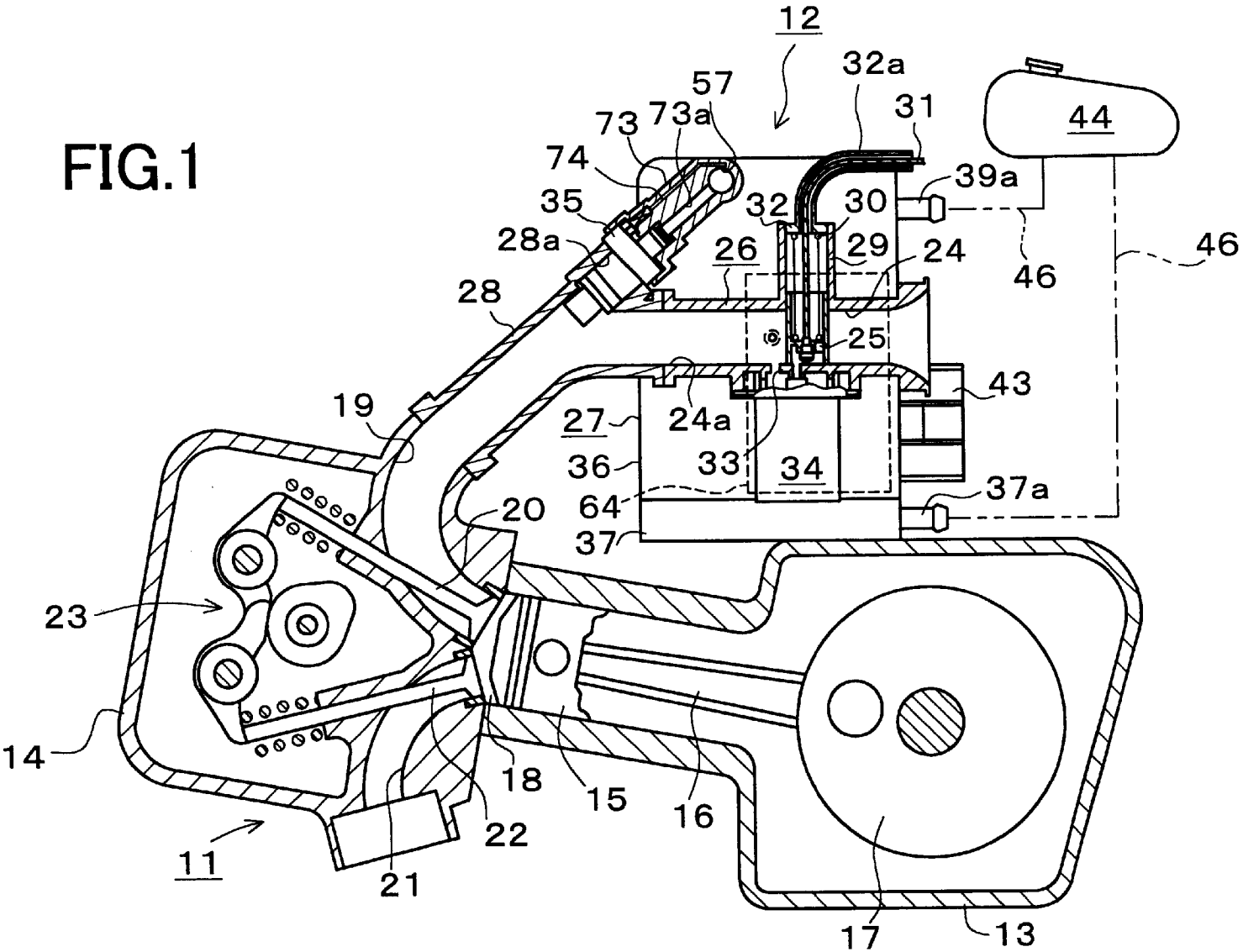
FIG. 1 is a schematic partially sectional view of an engine and an air-fuel mixture control device in a first embodiment according to the present invention.

FIG. 1 schematically shows an engine 11 and an air-fuel mixture control device 12 which is united as an assembly. The engine 11 is provided with a cylinder block 13 and a cylinder head 14. The cylinder block 13 has a piston 15, a connecting rod 16, and a crankshaft 17 connected to the piston 15 through the rod 16. The cylinder head 14 is formed with an air-intake port 19 through which a combustible mixture of air and fuel is fed into a combustion chamber 18, an air-intake valve 20 for opening/closing the port 19, a discharge port 21 for discharging burnt gas from the combustion chamber 18, a discharge valve 22 for opening/closing the port 21, and a valve driving mechanism 23 for driving the valves 20 and 22 respectively to open and close.

In the present embodiment, the air-fuel mixture control device 12 is operated to control a combustible air-fuel mixture to be supplied to the combustion chamber 18 of the engine 11. The air-fuel mixture control device 12 is provided with a throttle body 26 including an air-intake passage 24 and a throttle valve 25 disposed in the passage 24, and a body case 27 for holding therein a plurality of fuel supplying devices in a unit configuration with respect to the body 26. The throttle body 26 and the body case 27 are integrally molded of resin. An outlet 24*a* of the air-intake passage 24 is connected with an end (an inlet) of an air-intake manifold 28 made of resin, and another end (an outlet) of the manifold 28 is connected with the air-intake port 19, thus providing communication between the air-intake passage 24 and the air-intake port 19.

Figure 2:
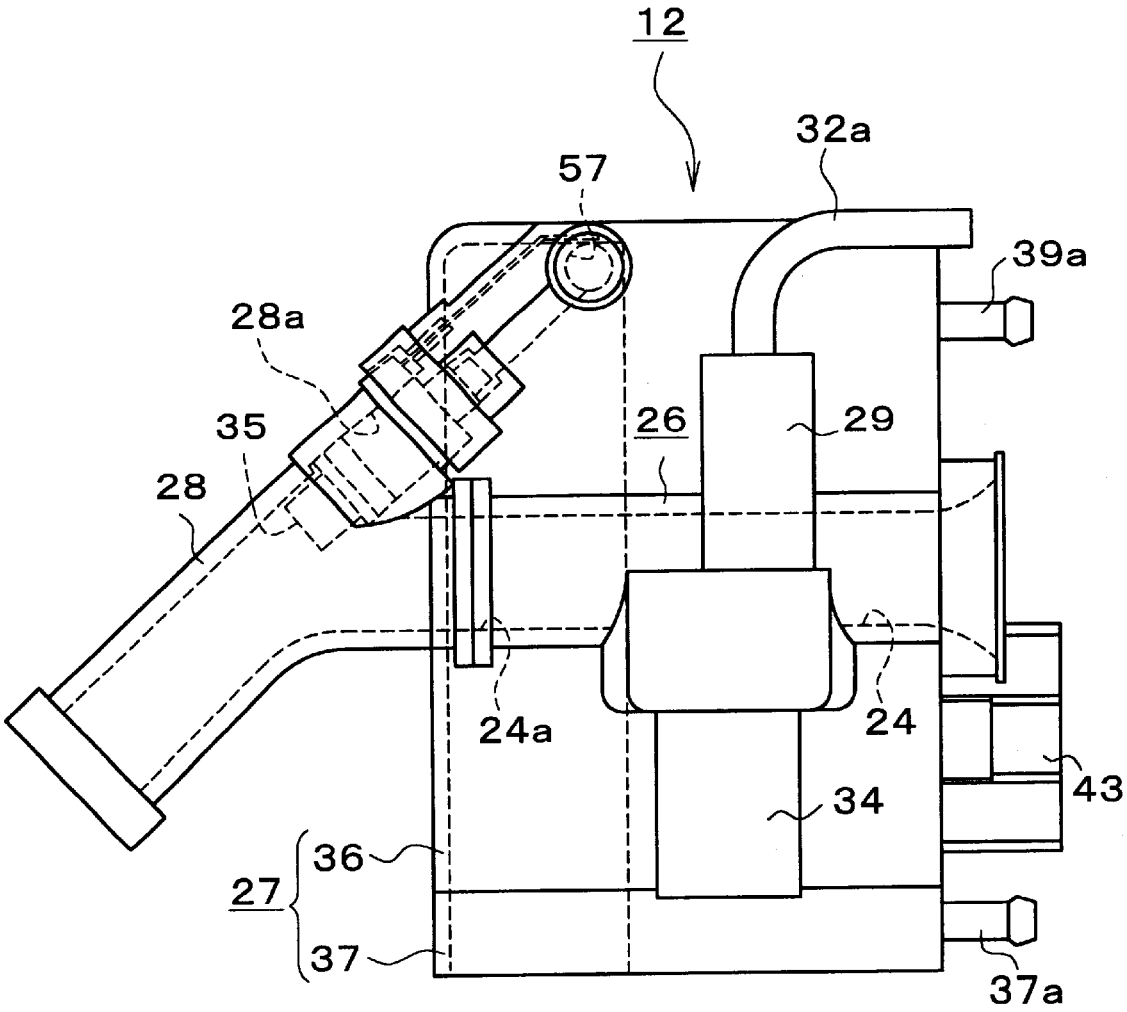
FIG. 2 is a front view of the air-fuel mixture control device in the first embodiment.
Figure 3:
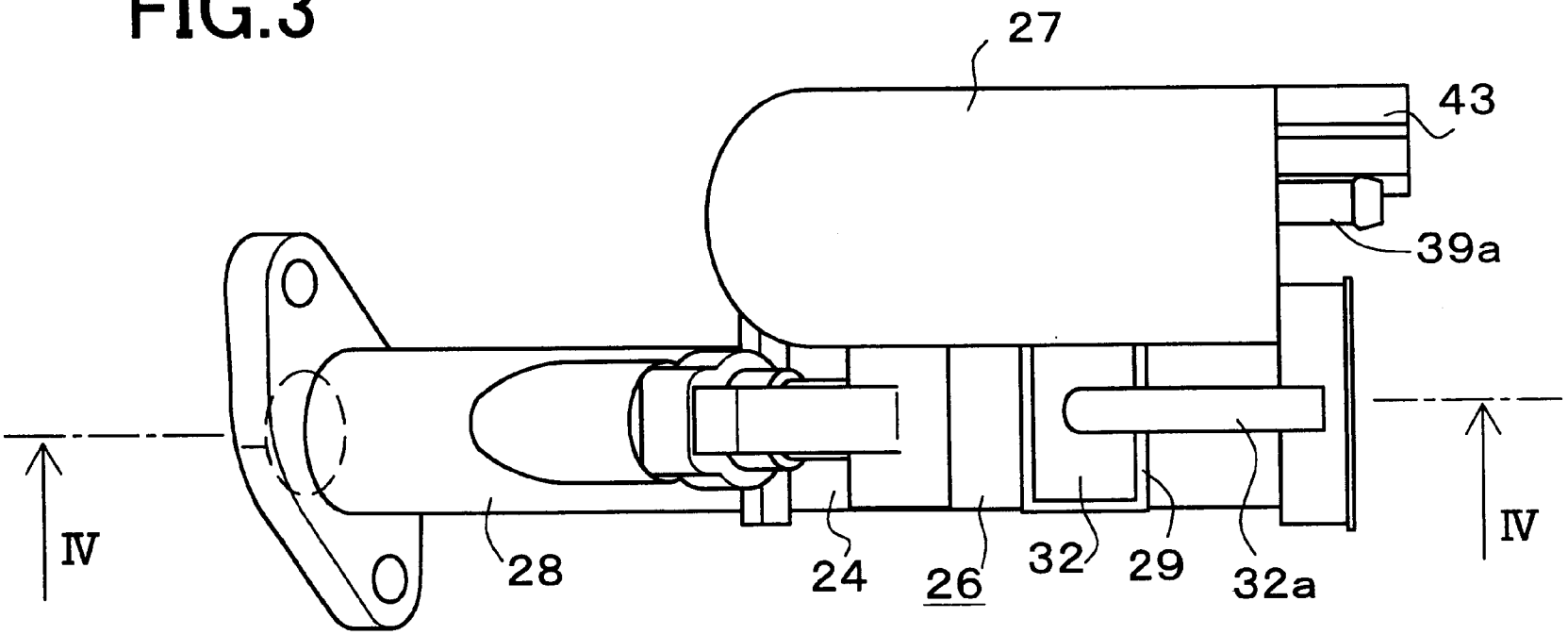
FIG. 3 is a top view of the air-fuel mixture control device shown in FIG. 2.
Figure 4:
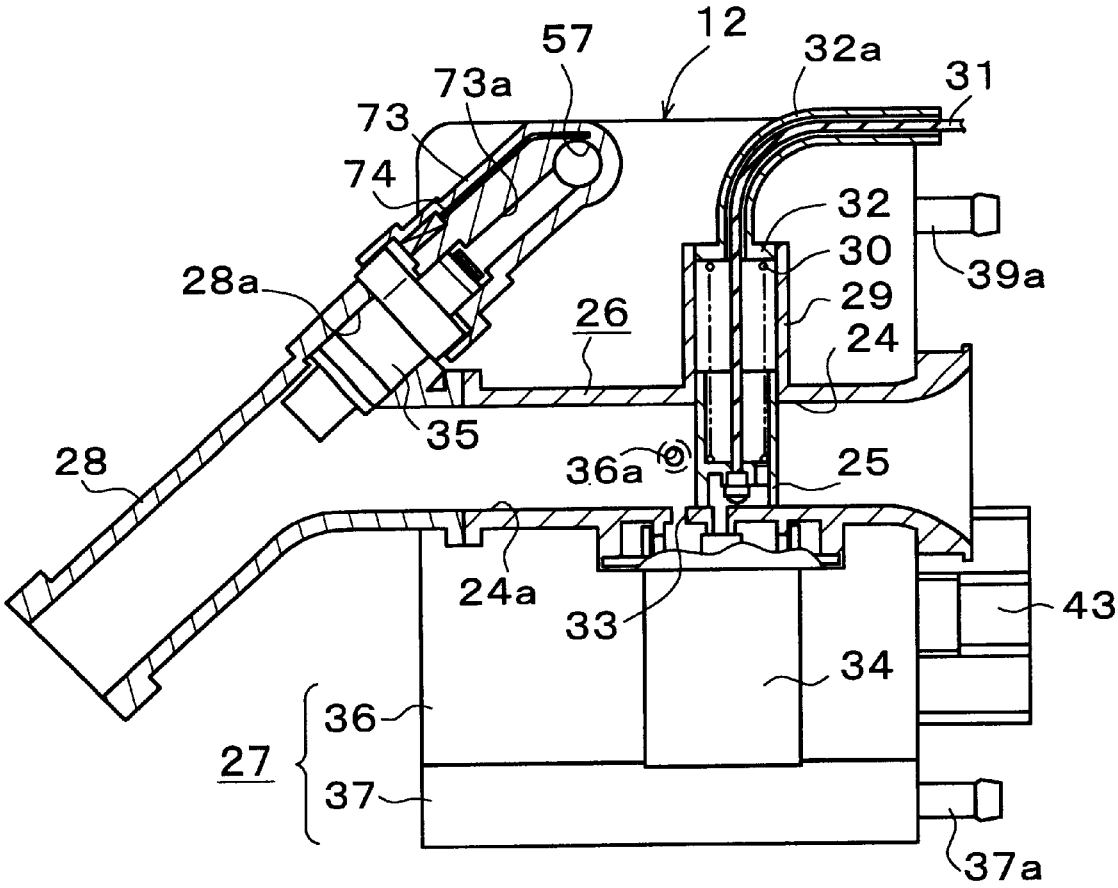
FIG. 4 is a sectional view of a throttle body of the fuel supply device taken along line IV—IV in FIG. 3.

FIG. 2 is a front view of the air-fuel mixture control device 12, i.e., the throttle body 26 in the present embodiment. FIG. 3 is a top view of the same of FIG. 2. FIG. 4 is a sectional view of the throttle body 26 of the fuel supply device 12 taken along line IV—IV in FIG. 3.

The throttle valve 25 is a piston valve movable in a perpendicular direction to the air-intake passage 24. The throttle body 26 includes an integral cylinder 29 which is perpendicularly communicated with the passage 24. The throttle valve 25 is slidably assembled in the cylinder 29 (see FIG. 1). A cover 32 is fitted in the opening of the cylinder 29 opposite to the air-intake passage 24. A spring 30 provided between the throttle valve 25 and the cover 32 normally urges the valve 25 downward (in FIG. 1) to close the air-intake passage 24. A wire 31 connected with the valve 25 is joined to a handlebar (not shown) which is controlled by a driver. A wire guide 32*a* integral with the cover 32 serves to guide the wire 31 to the handlebar. When this wire 31 is pulled by operation of the handlebar, the throttle valve 25 is moved upward against the urging force of the spring 30, thereby opening the air-intake passage 24. Thus, outside air is taken in the air-intake passage 24.

The throttle body 26 is also provided with a bypass 33 formed accompanying the air-intake passage 24 to bypass around the throttle valve 25. An idle speed control valve (ISC valve) 34 is fixed to the throttle body 26 by hot caulking. This ISC valve 34 is electrically controlled to open and close the bypass 33. At a full close of the throttle valve 25, namely, at idling of the engine 11, the ISC valve 34 is controlled to make fine regulation of the quantity of intake air to be supplied to the engine 11.

A fuel injection valve (injector) 35 is disposed adjacent to the outlet 24*a* of the air-intake passage 24. The injector 35 is fitted in a mounting hole 28*a* formed near the inlet of the air-intake manifold 28. This injector 35 is electrically controlled to inject fuel into the air-intake manifold 28. Accordingly, the fuel is injected from the injector 35 into the air allowed to flow from the passage 24 to the manifold 28, producing a combustible air-fuel mixture, which is taken in the combustion chamber 18 upon open of the air-intake valve 20.

Figure 5:
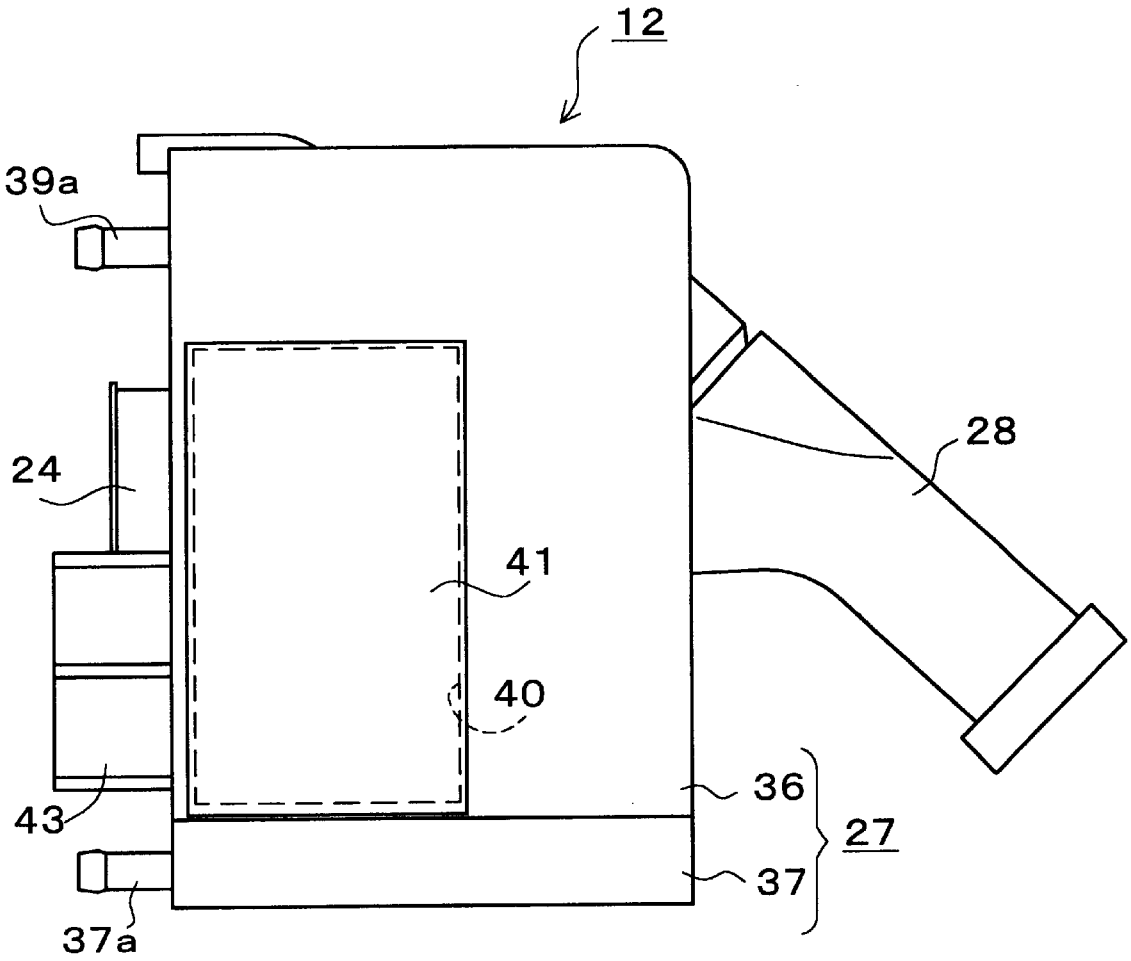
FIG. 5 is back view of the device shown in FIG. 2, corresponding to a front view of a body case of the fuel supply device.
Figure 6:
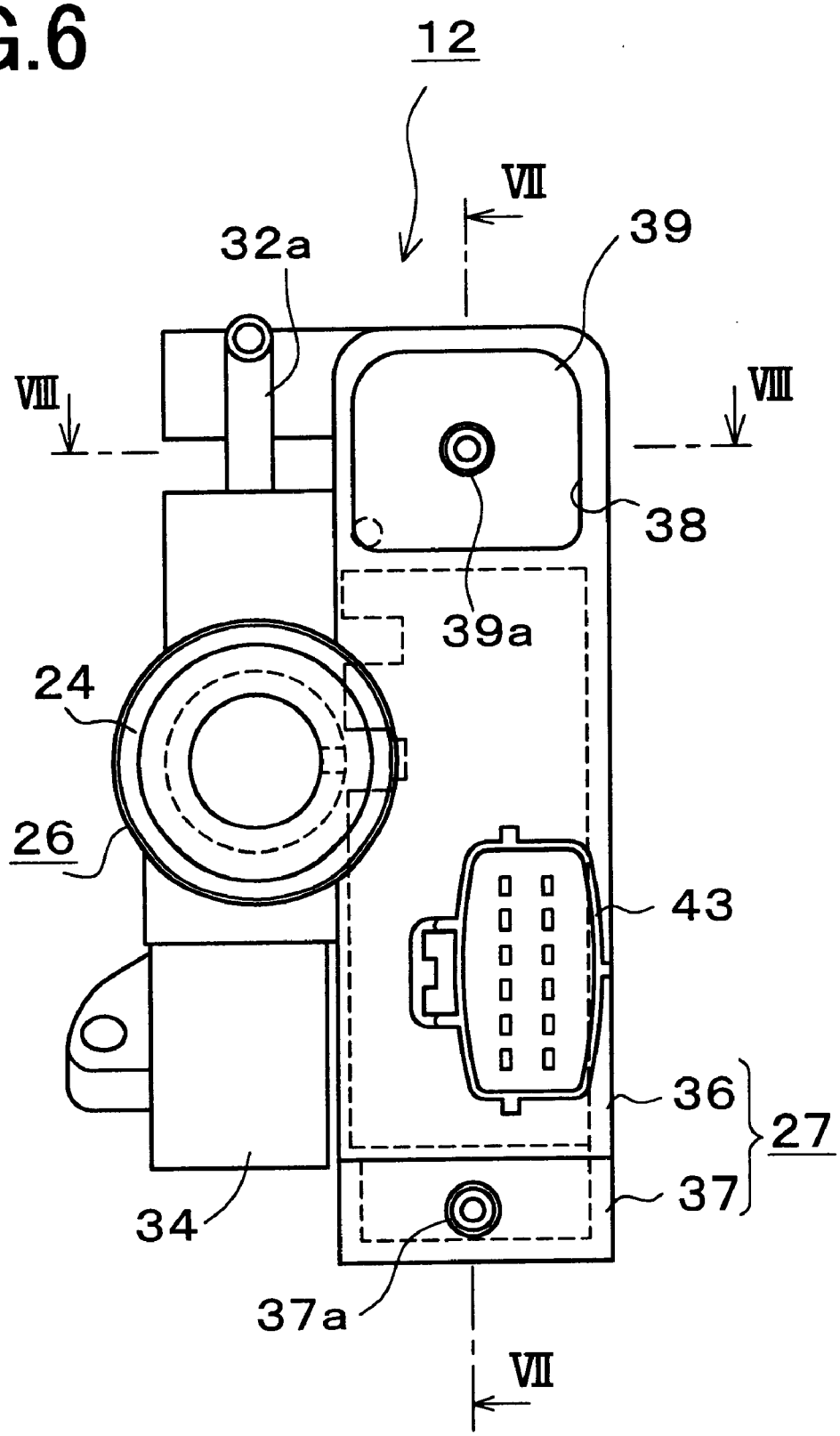
FIG. 6 is a left side view of the fuel supply device of FIG. 5.
Figure 7:
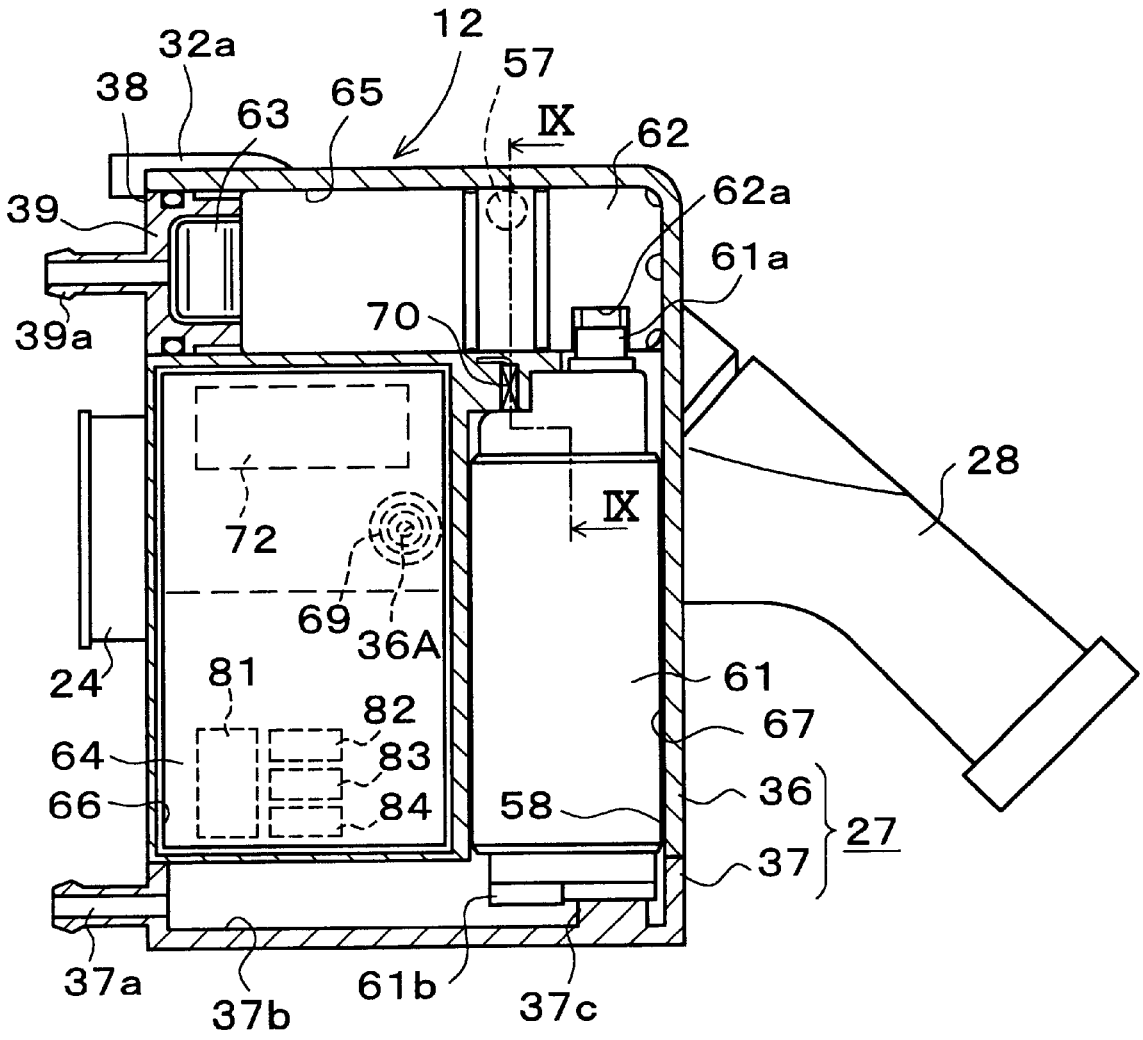
FIG. 7 is a sectional view of the device taken along a line VII—VII in FIG. 6.
Figure 8:
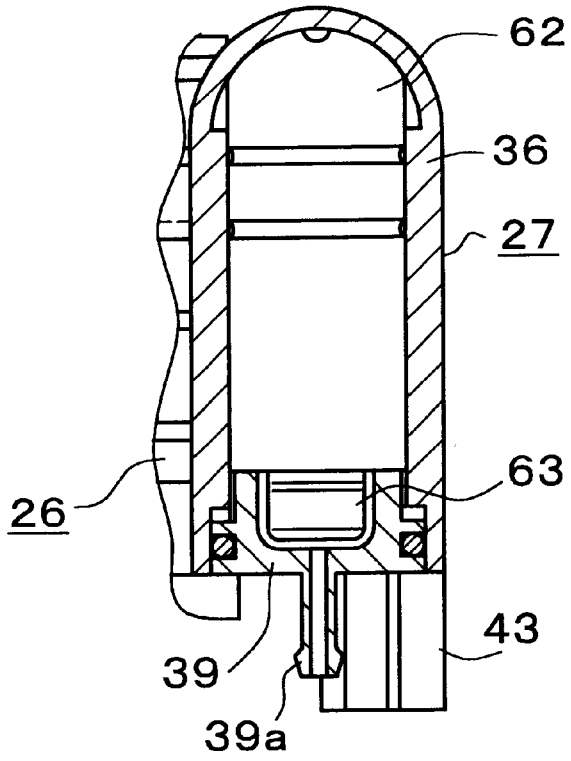
FIG. 8 is a sectional view of a part of the device taken along a line VIII—VIII in FIG. 6.
Figure 9:
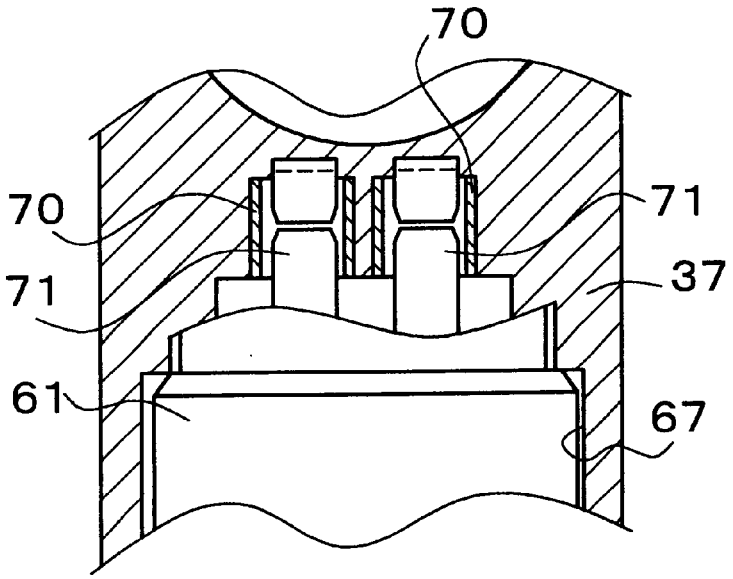
FIG. 9 is an enlarged sectional view of a part of the device taken along a line IX—IX in FIG. 7.

FIG. 5 is a back view of the device 12, corresponding to a front view of the body case 27. FIG. 6 is a left side view of the device 12 of FIG. 5. FIG. 7 is a sectional view of the device 12 taken along the line VII—VII in FIG. 6. FIG. 8 is a sectional view of a part the device 12 taken along the line VIII—VIII in FIG. 6. FIG. 9 is an enlarged sectional view of a part of the device 12 taken along the line IX—IX in FIG. 7.

As shown in FIGS. 5 and 6, the body case 27 is constructed of a main case 36, a lower cover 37 fixed to the underside of the main case 36, a first opening 38 formed in the left side face (in FIG. 7) of the main case 36, a plug 39 for closing the opening 38, a second opening 40 formed in the front face of the main case 36, a front cover 41 for closing the second opening 40, and an electrical wiring connector 43 disposed in the left side face (in FIG. 5) of the main case 36. The plug 39 is made of resin with an integral outlet pipe 39*a* serving as a fuel outlet. The lower cover 37 is made of resin with an integral inlet pipe 37*a* serving as a fuel inlet. As shown in FIG. 1, those inlet pipe 37*a* and outlet pipe 39*a* are connected to a fuel tank 44 mounted on the motorcycle by way of pipes 45 and 46 respectively. The inlet pipe 37*a* is used to admit the fuel supplied from the fuel tank 44 into the body case 27. The outlet pipe 39*a* is used to discharge the fuel out of the body case 27. In the motorcycle, the inlet pipe 37*a* is disposed below the outlet pipe 39*a*.

The main case 36, as shown in FIGS. 7 and 8, fixedly holds therein fuel supplying devices, namely, a fuel pump 61, a fuel filter 62, a pressure regulator 63, and an electronic control unit (ECU) 64. Each of the devices 61–63 has a substantially cylindrical shape, and the ECU 64 has a box shape. As shown in FIG. 7, the fuel filter 62 and the pressure regulator 63 are integrally combined by caulking. This combination of the fuel filter 62 and the pressure regulator 63 is arranged above and perpendicularly to the fuel pump 61. In this configuration, a discharge port 61*a* of the fuel pump 61 is inserted in an admission port 62*a* of the fuel filter 62 in a mutual engagement relation. Thus, the fuel pump 61 is directly connected with the fuel filter 62. The connecting part between the pump 61 and the filter 62 is sealed with an O-ring not shown.

The fuel pump 61 is electrically driven to discharge, at high pressure, the fuel supplied from the fuel tank 44. The fuel filter 62 is used for removing foreign substances included in the fuel discharged from the fuel pump 61. The pressure regulator 63 is arranged to regulate the pressure of the fuel discharged from the fuel pump 61 at a predetermined level. Excess fuel resulting from the pressure regulation is discharged out of the device 12 through the outlet pipe 39*a*.

The ECU 64 controls the injector 35 and others for the purpose of executing the fuel injection control and others. The ECU 64 includes a CPU 81; memories such as a ROM 82, a RAM 83, and a backup RAM 84; and a pressure sensor 69. The CPU 81 executes the fuel injection control and others by the use of the injector 35 in accordance with a control program stored in advance in the ROM 82. The pressure sensor 69 is used for detecting the intake negative pressure in the air-intake passage 24 as an air-intake condition for the fuel injection control. The sensor 69 corresponds to an air-intake condition detector of the invention. The main case 36 is formed with an admission hole 36*a* leading to the air-intake passage 24 at a position corresponding to the pressure sensor 69. This admission hole 36*a* is used for the admission of the negative pressure produced in the air-intake passage 24 downstream from the throttle valve 25, to the pressure sensor 69.

The main case 36 is provided with a fuel supply port 57 through which the fuel is supplied to the injector 35. On the other hand, the lower cover 37 includes a fuel passage 37*b* which allows the fuel having entered the body case 27 through the inlet pipe 37*a* to flow toward the fuel pump 61, and a projection 37*c* which is engaged with the underside of the pump 61 to press it upward in FIG. 7.

When the fuel pump 61 having the above structure is driven, the fuel is admitted into the body case 27 through the inlet pipe 37*a*, flowing through the fuel passage 37*b*, and sucked into the fuel pump 61 through a suction port 61*b* of the pump 61. The fuel is increased in pressure by the fuel pump 61, discharged from the discharge port 61*a*, cleaned by the fuel filter 62, and succeedingly regulated in pressure by the pressure regulator 63. Then, the fuel is supplied to the injector 35 through the fuel supply port 57. The excess fuel produced in the pressure regulator 63 is discharged through the outlet pipe 39*a*.

Figure 10:
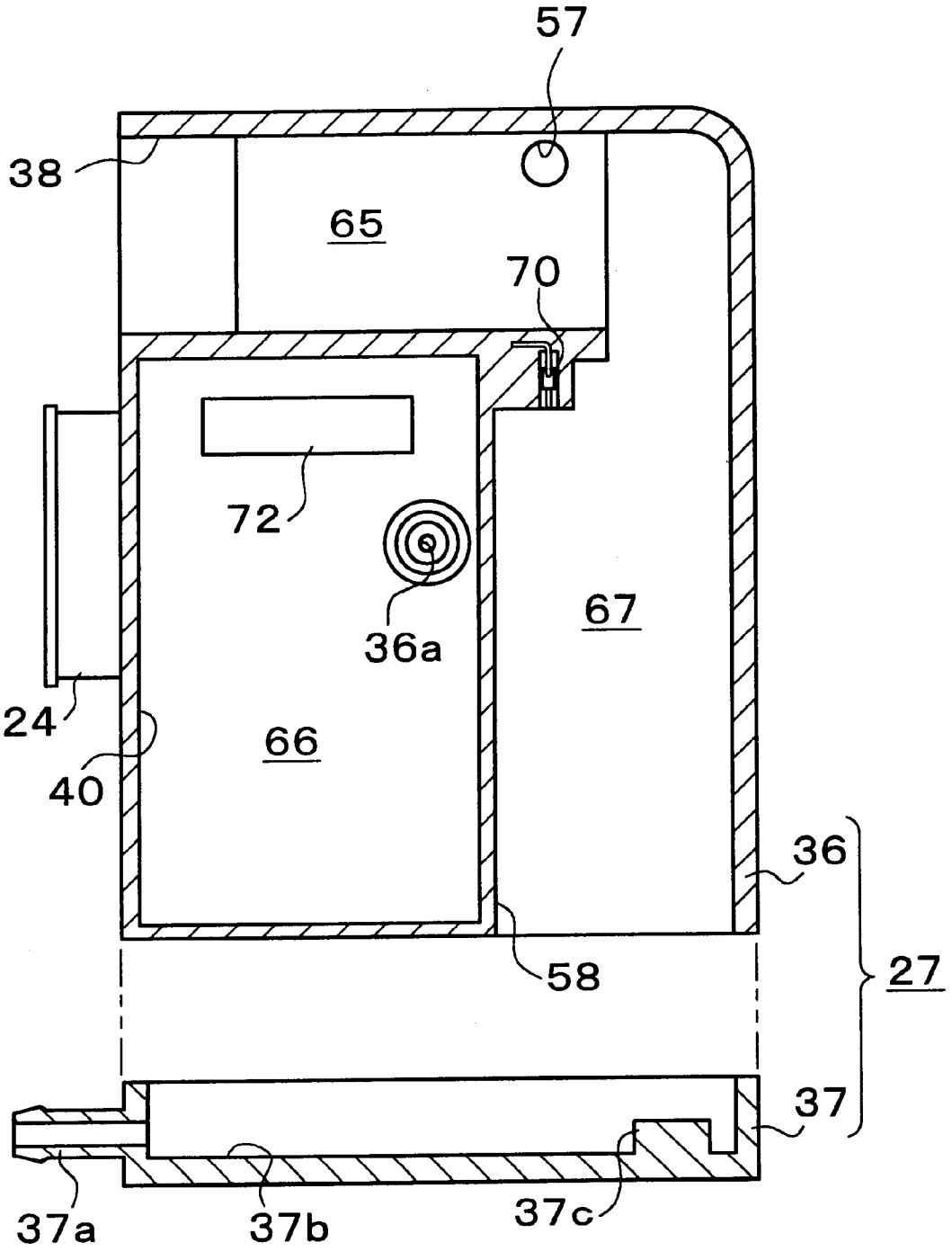
FIG. 10 is a sectional view of the body case in the embodiment.
Figure 11:
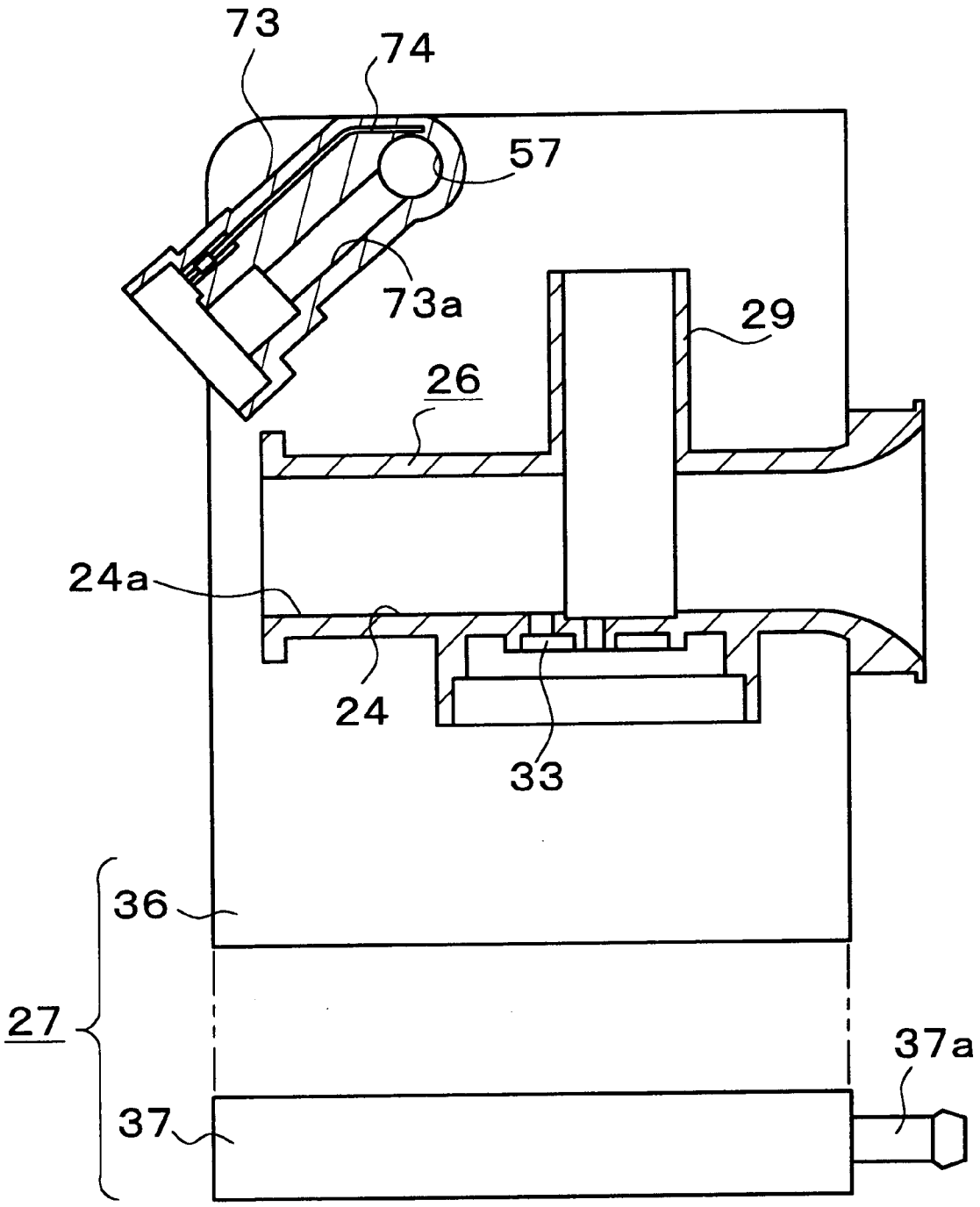
FIG. 11 is a sectional view of the throttle body with the body case exploded into a main body and a lower cover.

FIG. 10 is a sectional view of only the body case 27. FIG. 11 is a sectional view of the throttle body 26 with the body case 27. It is to be noted that the body case 27 is illustrated in FIGS. 10 and 11 in an exploded state into the main case 36 and the lower cover 37. As shown in FIG. 10, the main case 36 is internally provided with a first recess 65, a second recess 66, and a third recess 67, which are matched in shape to the outside shapes of the devices 61–64 respectively. The first opening 38 is used for insertion/removal of the combined fuel filter 62 and pressure regulator 63 with respect to the first recess 65. The main case 36 also has a third opening 58 used for insertion/removal of the fuel pump 61 with respect to the third recess 67 from below.

As shown in FIGS. 7 and 9, the main case 36 is provided with current supply terminals 70 disposed adjacently to a part of the third recess 67 so as to come into alignment with electrode terminals 71 of the pump 61 when inserted in the third recess 67. Thus, the terminals 70 of the main case 36 are connected with the terminals 71 of the pump 61. In addition, the second recess 66 is provided with an electrode terminal 72 which is connected to an electrode terminal not shown of the ECU 64 when inserted in the second recess 66.

As shown in FIG. 11, the main case 36 is provided with a piping cap 73 integrally formed therewith. This piping cap 73 has a fuel passage 73*a* communicating with the fuel supply port 57. As shown in FIG. 4, the piping cap 73 is disposed covering the head portion of the injector 35 placed in the air-intake manifold 28, thereby allowing the flow of the fuel from the fuel supply port 57 to the injector 35. The piping cap 73 is provided in advance with a wiring 74 which is connected to an electrode terminal of the injector 35.

The above fuel supplying devices 61–64 are inserted and fixed in place in the body case 27 in the following manner. The fuel filter 62 and the pressure regulator 63 are first inserted into the first recess 65 of the main case 36 through the first opening 38. The plug 39 is then fitted in the first opening 38 to close it. In the present embodiment, a hot plate welding manner may be adopted to fix the plug 39 there.

Subsequently, the fuel pump 61 is inserted into the third recess 67 of the main case 36 through the third opening 58. The discharge port 61*a* of the pump 61 is thus engaged in the admission port 62*a* of the fuel filter 62 and therefore the electrode terminals 71 of the pump 61 are connected with the current supply terminals 70 respectively. Then, the lower cover 37 is fixed to the underside of the main case 36, closing the third opening 58. The hot plate welding manner may also be adopted to fix the lower cover 37 to the main case 36 in the present embodiment. With the lower cover 37 fixed as above, the projection 37*c* of the cover 37 presses the bottom of the fuel pump 61, thus securing the pump 61 in the third recess 67.

Next, the ECU 64 is inserted in the second recess 66 through the second opening 40 and the electrode terminal of the ECU 64 is connected with the electrode terminal 72. The front cover 41 is fixed to the front face of the main case 36, thereby closing the second opening 40. Similarly, the hot plate welding manner may be adopted to fix the front cover 41.

In the present embodiment, the plug 39, the front cover 41, and the lower cover 37 are provided for closing the first, second, and third openings 38, 40, and 58, respectively. They correspond to cover members of the invention.

As mentioned above, the air-fuel mixture control device 12 is configured as a unitary assembly constructed of the throttle body 26, the injector 35, the fuel pump 61, the fuel filter 62, the pressure regulator 63, the ECU 64, and others.

The unitary air-fuel control device 12 is subjected to a basic characteristic test prior to the mounting in the engine 11. This characteristic test is aimed at measuring an actual injection quantity of the fuel actually injected from the injector 35 when the injector 35 is preliminarily experimentally controlled in accordance of a predetermined injection signal to inject the fuel at a predetermined request quantity, and thereby determining a deviation between the measured value and a request injection quantity as the dispersion in injection quantity. This characteristic test is intended to solve the dispersion in the measured injection quantity in order to standardize the characteristics of the air-fuel mixture to be produced in individual assemblies, or air-fuel mixture control devices 12.

Figure 12:
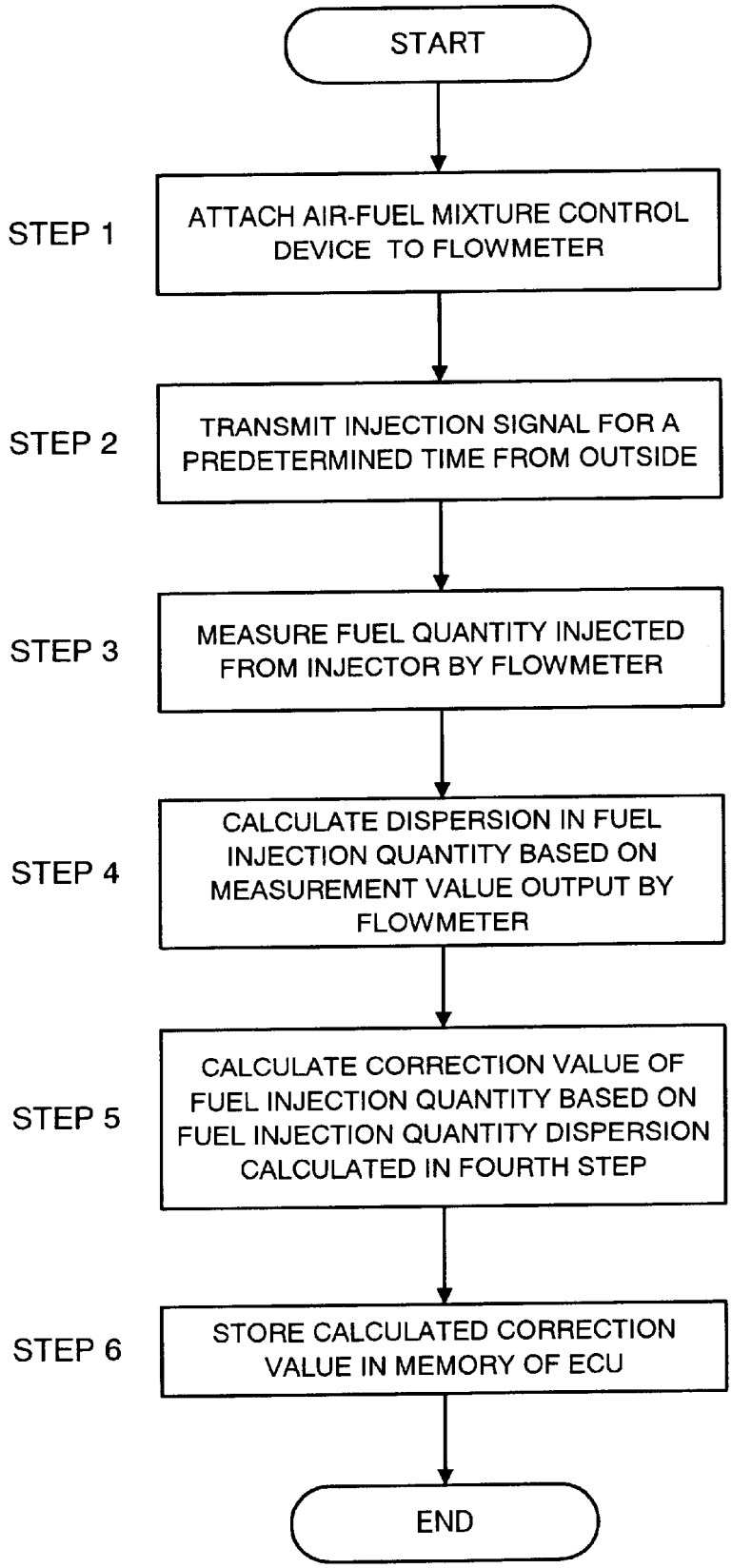
FIG. 12 is a flowchart showing a routine of a working procedure of a characteristic test and others in the first embodiment.

FIG. 12 is a flowchart showing a working procedure related to the characteristic test and others.

At first, in a first step, the air-fuel mixture control device 12 is attached to a predetermined flowmeter.

In a second step, with the device 12 attached, a predetermined injection signal is applied to the injector 35 from the outside. This injection signal corresponds to a request injection time needed for obtaining a predetermined request injection quantity.

In a third step, the flowmeter measures a quantity of the fuel actually injected from the injector 35 in response to the injection signal applied as above.

In a fourth step, the dispersion in the fuel injection quantity is calculated based on a value measured by the flowmeter.

Figure 13:
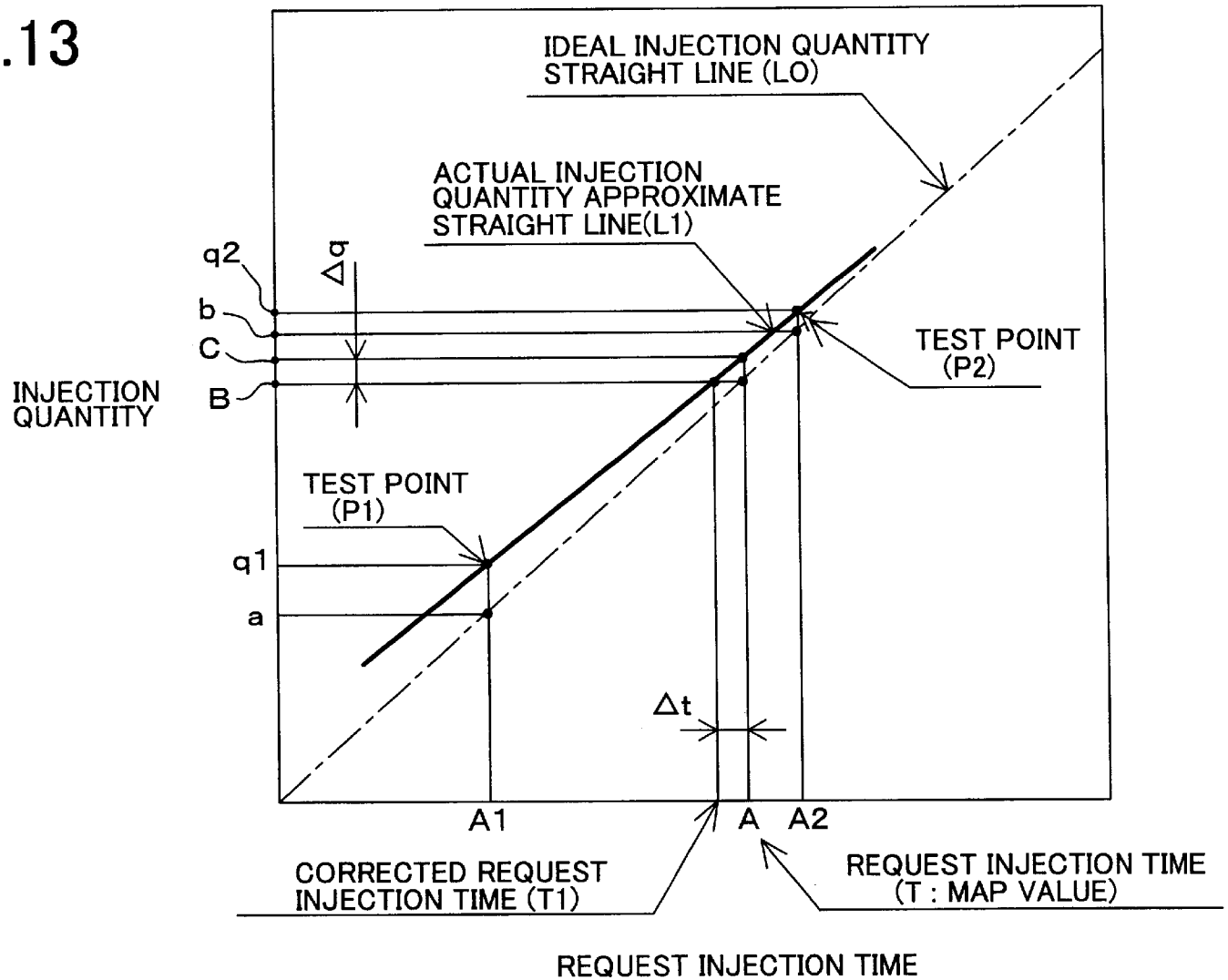
FIG. 13 is a graph for explaining a method for calculating the dispersion in injection quantity in the first embodiment.

The calculating method in the fourth step is explained below with reference to a graph shown in FIG. 13. This graph indicates a relationship of "an injection quantity" of the fuel injected from the injector 35 with respect to "a request injection time (meaning the energization time of the injector 35)" supplied in the form of an injection signal to the injector 35. In this graph, a dash-single-dot line represents "an ideal injection quantity straight line L0" which shows the relationship of an ideal injection quantity with respect to the "request injection time". A sold line represents "an actual injection quantity approximate straight line L1" including the dispersion in the fuel injection quantity.

The above calculation of the injection quantity dispersion includes a calculation of a linear equation of the actual injection quantity approximate line L1. To be more specific, as shown in the graph, assuming the request injection time T to be a predetermined value A, a set value of the request injection quantity is "B" based on the ideal injection quantity line L0. At this time, a measured value of the injection quantity without correction obtained from the flowmeter is assumed as "C". Accordingly, a deviation of the injection quantity value C with respect to the set value B of the request injection quantity becomes $\Delta q$.

To obtain the request injection quantity of the set value B, the value A of the request injection time T has to be corrected by a deviation $\Delta t$ to obtain a corrected request injection time T1. To determine this corrected request injection time T1, it is necessary to find a linear equation of the actual injection quantity approximate line L1.

For that purpose, two test points P1 and P2 on the straight line L1 are determined. These test points P1 and P2 can be obtained by finding a set value "a" and a measurement value q1 of the injection quantity with respect to a certain value A1 of the request injection time T and also a set value "b" and a measurement value q2 of the injection quantity with respect to a certain value A2 of the request injection time T. From those values a, b, q1, and q2, the following linear equation (1) related to the actual injection quantity approximate straight line L1 is obtained.

$$(b-a)Y=(q2-q1)X+b\cdot q1-a\cdot q2 \quad (1)$$

In the above manner, the linear equation (1) is obtained as the dispersion in the injection quantity.

In a fifth step, a correction value of the fuel injection quantity is calculated from the injection quantity dispersion calculated as above. This correction value is obtained by determining the corrected request injection time T1 in the following calculation equation (2) from the above calculated actual injection quantity approximate straight line L1.

$$T1=\{k1\cdot T\cdot(b-a)-b\cdot q1+a\cdot q2\}/(q2-q1) \quad (2)$$

In a sixth step, finally, the correction value determined as above is stored in the backup RAM 84 of the ECU 64 of the air-fuel mixture control device 12. To be more specific, the calculation equation (2) obtained as above is stored in the backup RAM 84 as the correction value. Thus, in each of the control devices 12, the backup RAM 84 stores the calculation equation (2) as the correction value with respect to the fuel injection dispersion that is preliminarily experimentally determined in each assembly.

When the operations for test and standardization are finished, the manufacture of the device 12 prior to the mounting in the engine 11 is completed.

The above calculation equation (2) is used for calculating the fuel injection quantity at the time when the ECU 64 executes a fuel injection quantity control.

To be more specific, during operation of the engine 11, the ECU 64 calculates a value of the request injection time T with reference to a predetermined function data (an injection quantity map) based on an intake negative pressure value detected by the pressure sensor 69 and an engine rotational speed value detected by a rotational speed sensor (not shown) additionally mounted in the engine 11.

The ECU 64 reads the calculation equation (2) from the backup RAM 84 and substitutes the above determined value of the request injection time T into the equation (2), thereby calculating a value of the corrected actual injection time T1. Namely, the ECU 64 corrects the fuel injection quantity based on the correction value stored in the backup RAM 84 to control the fuel injection quantity.

As mentioned above, the air-fuel mixture control device 12 in the first embodiment constructs an air-fuel mixture control system for controlling an air-fuel mixture to be supplied to the combustion chamber 18 by the application of the correction value stored in advance in the RAM 84 to the actual fuel injection quantity control in the engine 11.

As explained above, according to the air-fuel mixture control device 12 and the air-fuel mixture control system in the present embodiment, the throttle body 26, the injector 35, the fuel pump 61, the fuel filter 62, the pressure regulator 63, the ECU 64, and others are united as an assembly. Accordingly, the characteristics of the flow quantity of air allowed to flow in the intake passage 24 through the throttle valve 25 and the characteristics of the injection quantity of fuel to be injected into the intake manifold 28 through the fuel pump 61, the fuel filter 62, the pressure regulator 63, and the injector 35 are determined in each assembly, which are different among assemblies.

In each individual assemblies, or air-fuel mixture control devices 12, therefore, the injection quantity of the fuel to be injected into the intake manifold 28 is regulated, while the air flow quantity in the intake passage 24 and the intake manifold 28 is regulated. The characteristics of the air-fuel mixture produced in the intake manifold 28 can be controlled in each of the air-fuel mixture control devices 12, separately from the main body of the engine 11. Therefore, the air-fuel mixture control device 12, which differs from the conventional device which is subjected to a test operation on an engine-by-engine basis, can contribute downsizing of the test equipment.

In the air-fuel mixture control device 12 and the air-fuel mixture control system in the present embodiment, the backup RAM 84 of the ECU 64 stores in advance the calculation equation (2) to be used for determining the corrected request injection quantity T1 as the correction value with respect to the injection quantity dispersion preliminarily experimentally determined in each assembly. During operation of the engine 11, the ECU 64 corrects the request fuel injection quantity based on the calculation equation (2) stored in the backup RAM to control the fuel injection quantity. Accordingly, the injection quantity dispersion in the air-fuel control device 12 is individually corrected in each assembly, thereby standardizing the characteristics of the air-fuel mixture. Thus, the dispersion in fuel flow quantity in the fuel-system components, namely, the injector 35, the fuel pump 61, the fuel filter 62, and the pressure regulator 63 can be absorbed. This makes it possible to reduce the influence of the fuel flow quantity dispersion to be exerted on the air-fuel mixture. Consequently, the air-fuel ratio of the engine can be precisely regulated to a request air-fuel ratio.

In other words, the characteristics of air-fuel mixture can be controlled in consideration of the dispersion in quality and performance of the throttle valves 25 and the devices 35 and 61–64. The performance and quality of the air-fuel mixture control device 12 in the form of an assembly can be controlled accordingly.

In the conventional device, the fuel injection quantity is corrected based on the output torque of an engine. This would totally correct the dispersion in flow quantity in the fuel-system components and the dispersion in engine friction, which might cause insufficient conformity of air-fuel ratio and deteriorate engine emission. In the air-fuel mixture control device 12 and the air-fuel mixture control system in the first embodiment, on the other hand, only the characteristics of the air-fuel mixture is controlled in order to correct the dispersion in fuel flow quantity of the fuel-system components, so that the correction of the fuel injection quantity can directly be reflected in the conformity of the air-fuel ratio. In this regard, the conformity of the air-fuel ratio can be precisely effected, thereby improving the emission of the engine 11.

According to the air-fuel mixture control device 12 in the first embodiment, the workability in attaching or detaching the devices 61–64 can be enhanced and a unitary device with high water-resistance, dust-resistance, and shock-resistance can be realized. Furthermore, the throttle body 26 and the case body 36 are formed of resin in one piece and the intake manifold 28 made of resin is used. This can achieve reduction in weight of the device 12 as an assembly. In this regard, the workability in mounting/demounting the air-fuel mixture control device 12 with respect to a motorcycle can be enhanced, thus distributing the reduction in weight of the motorcycle.

According to the air-fuel mixture control device 12 in the first embodiment, the fuel pump 61 and the pressure regulator 63 can be handled as a single piece with respect to the throttle body 26. No structure is needed for fixing the devices 61 and 63 to another component such as the fuel tank 44 and the like. Therefore, the external appearance of the fuel tank 44 is not spoiled, enhancing the degree of flexibility in design of a vehicle including the device 12. The fuel pump 61 and the pressure regulator 63 are not accommodated in the fuel tank 44, so that the fuel tank 44 can be reduced in size. Since the fuel pump 61 is assembled inside the body case 27, furthermore, the reduction of the noise by the pump 61 at idling can be achieved.

In the fuel supply device 12 in the present embodiment, when the fuel pump 61 is simply fitted in the body case 27, the electrode terminal 71 of the pump 61 are correspondingly connected with the current feeding terminal 70. This makes it possible to save time and labor for the wiring connection relating to the fuel pump 61. Similarly, the ECU 64 is simply fitted in the body case 27, while the electrode terminal of the ECU 64 is connected with the electrode terminal 72, resulting in the saving in time and labor for the wiring connection relating to the ECU 64. As a result, the number of parts and the number of assembling steps needed for electrical wiring and others can be reduced and therefore the workability in attaching/detaching the fuel pump 61 and the ECU 64 with respect to the throttle body 26 can be enhanced. In addition, the ECU 64 is incorporated in the body case 27 with the above wiring connection, and the fuel pump 61 and the injector 35 having an electrical relation to the ECU 64 are disposed adjacent to the body case 27, which can shorten the length of the electrical wiring.

Next, a second embodiment of an air-fuel mixture control device of an engine and an air-fuel mixture control device system of an engine according to the present invention will be described with reference to FIGS. 14 and 15. It is to be noted that like elements corresponding to those in the first embodiment are indicated by like numerals and their explanations are omitted. The following description is therefore made on different constructions from the first embodiment.

In the second embodiment, like the first embodiment, a pressure sensor 69 for detecting an intake negative pressure in an intake passage 24 and an intake manifold 28 are integrally provided in the air-fuel mixture control device assembly 12. An ECU 64 controls a fuel injection quantity based on values of an intake negative pressure detected by the pressure sensor 69 and an engine rotational speed detected by a rotational speed sensor. The air-fuel mixture control device 12 and the air-fuel mixture control system in the second embodiment differ in the content of the characteristic test and others from those in the first embodiment. To be more specific, differing from the first embodiment, the characteristic test in the second embodiment is made based on a measurement value by the pressure sensor 69 to correct a fuel injection quantity control.

Figure 14:
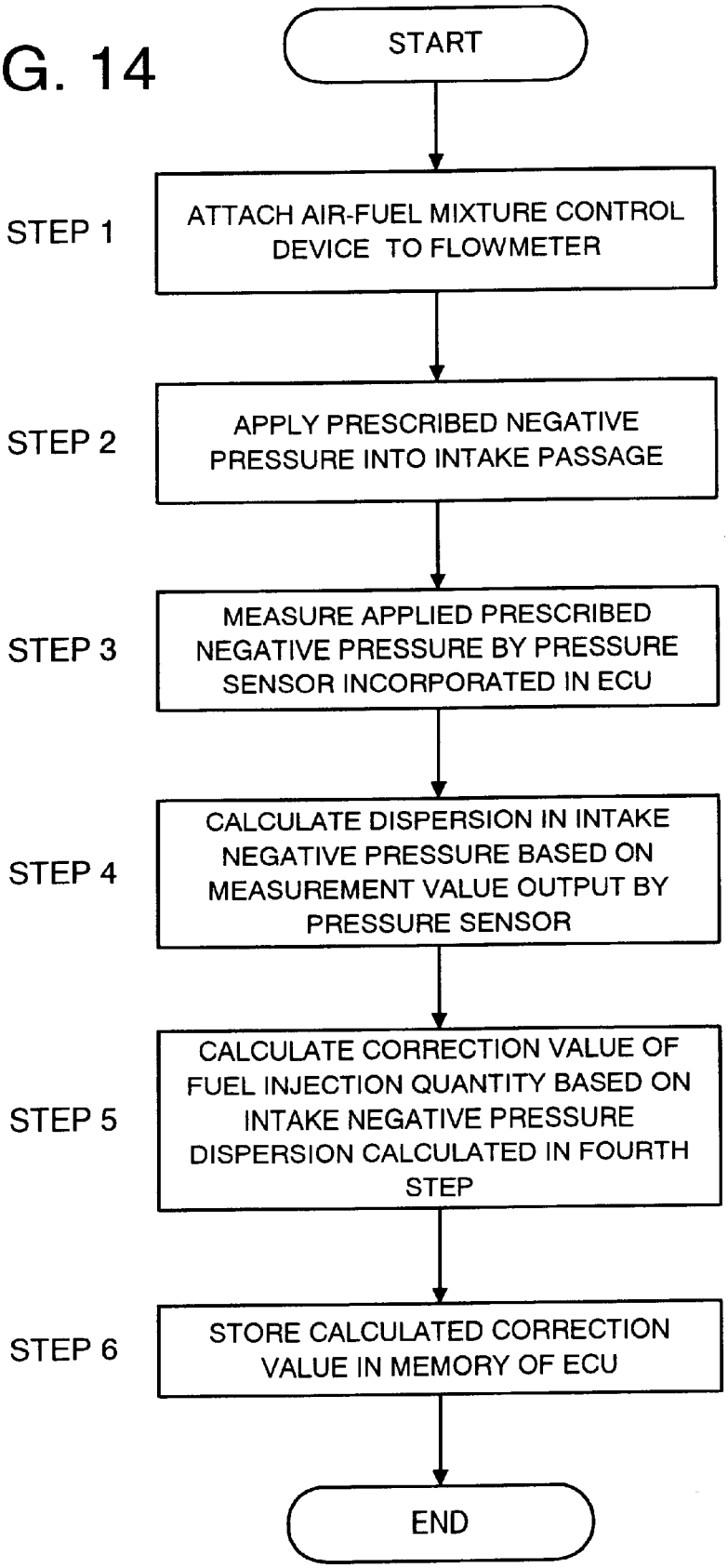
FIG. 14 is a flowchart showing a routine of a working procedure of a characteristic test and others in a second embodiment.

FIG. 14 is a flowchart showing a working procedure related to the characteristic test and others.

At first, in a first step, the air-fuel mixture control device 12 is attached to a predetermined measurement device.

In a second step, with the device 12 attached to the measurement device, a prescribed negative pressure is applied into the intake passage 24. This prescribed negative pressure corresponds to a value of negative pressure needed for obtaining a predetermined request injection quantity from a preset injection quantity map.

In a third step, the value of the prescribed negative pressure applied to the passage 24 is measured by the pressure sensor 69 incorporated in the ECU 64.

In a fourth step, the dispersion in the intake negative pressure is calculated based on the measurement value by the pressure sensor 69.

Figure 15:
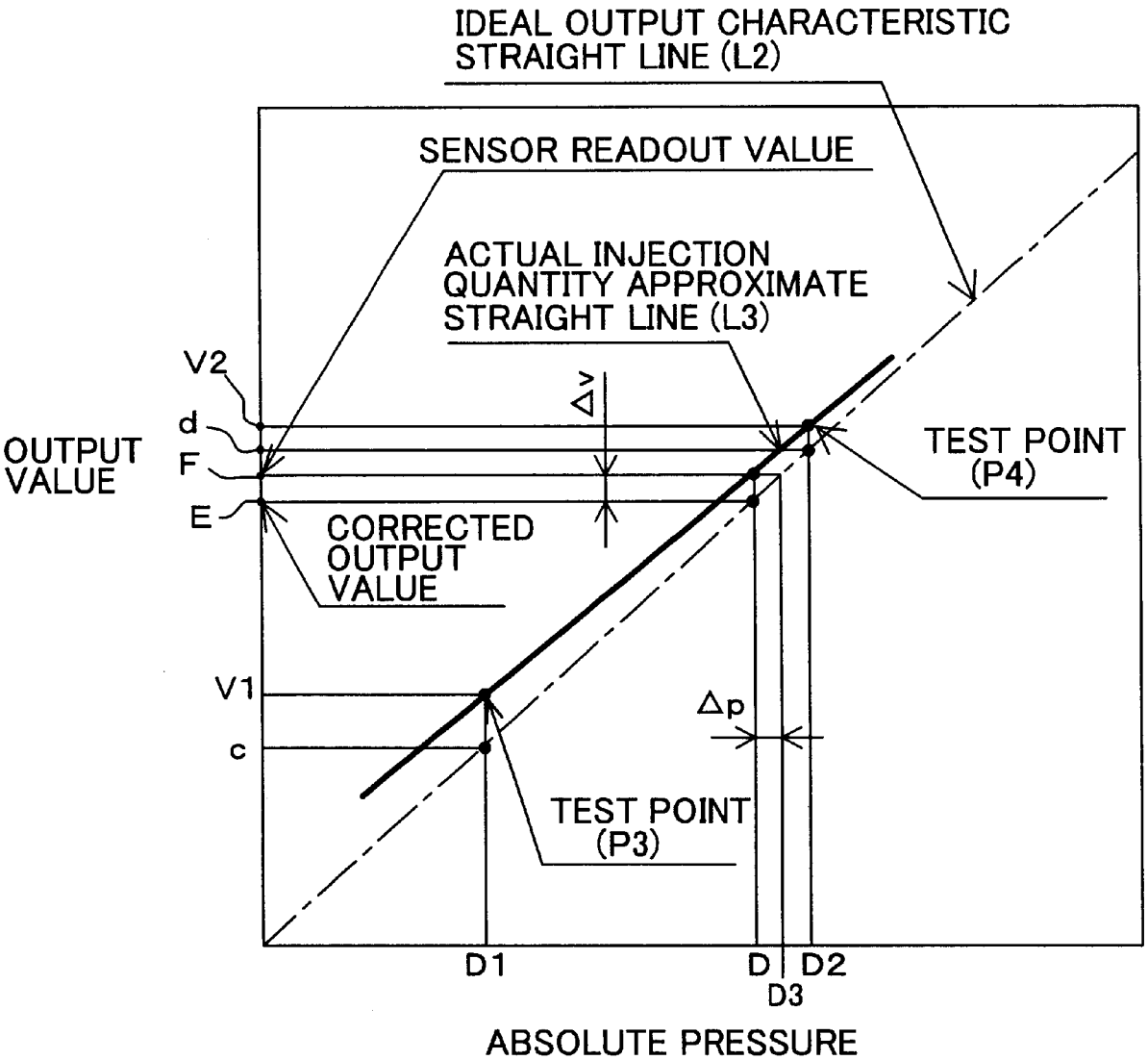
FIG. 15 is a graph for explaining a method for calculating the dispersion in injection quantity in the second embodiment.

The calculation method in the fourth step is explained in detail, referring to a graph shown in FIG. 15. This graph shows the relationship of "an output value" being the measurement value by the pressure sensor 69 with respect to "an absolute pressure" to be applied into the intake passage 24 as the prescribed negative pressure. In this graph, a dash-single-dot line represents "an ideal output characteristics straight line L2" which shows the relationship of an ideal output value with respect to the "absolute pressure". A solid line represents "an actual injection quantity approximate straight line L3" including the dispersion in intake negative pressure.

This calculation of the intake negative pressure dispersion includes a calculation of a linear equation of the actual injection quantity approximate straight line L3. To be more specific, as shown in the graph, a corrected output value corresponding to a certain value D of the absolute pressure becomes "E" based on the ideal output characteristics straight line L2. At this time, if a sensor readout value obtained from the pressure sensor 69 is "F", a deviation of the sensor readout value F with respect to the corrected output value E is ΔV. Furthermore, an absolute pressure value D3 corresponding to the sensor readout value F is determined by correcting the absolute value D by a deviation Δp. To obtain this corrected absolute pressure D3, it is necessary to determine a linear equation of the actual injection quantity approximate straight line L3.

For that purpose, two test points P3 and P4 on the straight line L3 are determined. These test points P3 and P4 can be obtained by finding an output value c and a measurement value V1 with respect to an absolute pressure value D1, and an output value d and a measurement value V2 with respect to an absolute pressure value D2. On a basis of those values c, d, V1, and V2, the following linear equation (3) related to the actual injection quantity approximate straight line L3 is obtained.

$$(d-c)Y=(V2-V1)X+d\cdot V1-c\cdot V2 \tag{3}$$

In the above manner, the linear equation (3) is obtained as the dispersion in intake negative pressure.

In a fifth step, a correction value of the fuel injection quantity is calculated based on the intake negative pressure dispersion obtained as above. This correction value is obtained by determining a corrected request injection time V0 in the following calculation equation (4) from the above determined linear equation (3) of the actual injection quantity approximate straight line L3.

$$V0=k2\{(d-c)\cdot V-d\cdot V1+c\cdot V2\}/(V2-V1) \tag{4}$$

Finally, in a sixth step, the correction value determined as above is stored in the backup RAM 84 of the ECU 64 of the air-fuel mixture control device 12. To be more specific, the calculation equation (4) obtained as above is stored in the backup RAM 84 as the correction value. Thus, in each of the control devices 12, the backup RAM 84 stores the calculation equation (4) as the correction value with respect to the fuel injection quantity dispersion preliminarily experimentally determined in each assembly.

When the operations for test and standardization are finished, the manufacture of the device 12 prior to the mounting in the engine 11 is completed.

The above calculation equation (4) is used for calculating the fuel injection quantity at the time when the ECU 64 executes a fuel injection quantity control.

To be more specific, during operation of the engine 11, the ECU 64 calculates a value of the request injection time V with reference to a predetermined injection quantity map based on the intake negative pressure value detected by the pressure sensor 69 and the engine rotational speed value detected by the rotational speed sensor.

The ECU 64 then reads the above calculation equation (4) from the backup RAM 84 and substitutes the value of the request injection time V calculated as above into the equation (4), thereby calculating a value of the corrected actual injection time V0. Namely, the ECU 64 corrects the fuel injection quantity based on the correction value stored in the backup RAM 84 to control the fuel injection quantity.

As mentioned above, the air-fuel mixture control device 12 in the second embodiment constructs an air-fuel mixture control system for controlling an air-fuel mixture to be supplied to the combustion chamber 18 by the application of the correction value stored in the RAM 84 to the actual fuel injection quantity control in the engine 11.

As explained above, in the present embodiment, like in the first embodiment, the ECU 64 refers to the correction value stored in the backup RAM 84 to control the fuel injection quantity. Therefore, in each of the control devices 12, the dispersion in the fuel injection quantity due to the detection dispersion related to the pressure sensor 69 is individually corrected, enabling standardization of the characteristics of air-fuel mixture. As a result of this, the dispersion in fuel flow quantity in the injector 35, the fuel pump 61, the fuel filter 62, and the pressure regulator 63 can be absorbed. This makes it possible to reduce the influence of the dispersion to be exerted on the air-fuel mixture. Consequently, the air-fuel ratio of the engine can be suitably regulated to a request air-fuel ratio.

The present invention may be embodied in other specific forms without departing from the essential characteristics thereof. For instance, the following alternatives may be adopted.

(I) In the above embodiments, the actual injection quantity approximate straight line L1 (L3) is obtained by determination of the two test points P1 and P2 (P3 and P4). One of the two points may be an imaginary point.

(II) In the above embodiments, the calculation equation (2) or (4) is stored in the backup RAM 84 to be used in the fuel injection quantity control. Instead of the equations (2) and (4), a calculated coefficient may be stored in the backup RAM 84 to be used in the fuel injection quantity control.

(III) In the above embodiment, a piston valve is used as the throttle valve 25. Alternatively, a butterfly valve may be used as the throttle valve.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto.

What is claimed is:

1. An air-fuel mixture control device for controlling a mixture of air and fuel to be supplied to a combustion chamber of an engine, the device including:

a throttle body including an intake passage communicated to the combustion chamber and a throttle valve provided in the intake passage;

a fuel injection valve for injecting the fuel into the intake passage;

a fuel supplying device for supplying the fuel under pressure to the fuel injection valve;

an electronic control unit for controlling an injection quantity of the fuel to be injected from the fuel injection valve; and a body case for uniting the throttle body, the fuel injection valve, the fuel supplying device, and the electronic control unit, forming an assembly;

wherein at least the fuel supplying device is mounted inside the body case.

2. The air-fuel mixture control device according to claim 1 further including a memory for storing a correction value to be used for correcting dispersion in the fuel injection quantity from the fuel injection valve in each united assembly, the memory being provided in the electronic control unit.

3. The air-fuel mixture control device according to claim 1, wherein the fuel supplying device includes a fuel filter and a pressure regulator which are integrally combined by caulking.

4. The air-fuel mixture control device according to claim 3, wherein the fuel supplying device further includes a fuel pump, and the combined fuel filter and pressure regulator are arranged perpendicularly to the fuel pump.

5. The air-fuel mixture control device according to claim 1, wherein an intake condition detector for detecting an intake condition in the intake passage is provided in the united assembly.

6. The air-fuel mixture control device according to claim 5, wherein the electronic control unit controls the fuel injection quantity based on at least the intake condition detected by the detector.

7. An air-fuel mixture control system for controlling a mixture of air and fuel to be supplied to a combustion chamber of an engine, the system including:

a throttle body including an intake passage communicated to the combustion chamber and a throttle valve provided in the intake passage;

a fuel injection valve for injecting the fuel into the intake passage; a fuel supplying device for supplying the fuel under pressure to the fuel injection valve; and an electronic control unit for controlling an injection quantity of the fuel to be injected from the fuel injection valve;

a body case for uniting the throttle body, the fuel injection valve, the fuel supplying device, and the electronic control unit, forming an assembly, at least the fuel supplying device being mounted inside the body case;

a memory for storing a correction value with respect to dispersion in the fuel injection quantity from the fuel injection valve in each united assembly, the correction value being determined by a preliminary test on an assembly-by-assembly basis, the memory being provided in the electronic control unit; and the electronic control unit being operated to correct the fuel injection quantity based on the correction value stored in the memory for control of the fuel injection quantity.

8. The air-fuel control system according to claim 7, wherein the preliminary test includes controlling the fuel injection valve to inject the fuel by a predetermined request injection quantity under a predetermined injection signal, then measuring an actual injection quantity of the fuel injected from the fuel injection valve, and determining a deviation of the measured value with respect to the request injection quantity as the dispersion in the injection quantity.

* * * * *